United States Patent [19]

Salyer et al.

[11] Patent Number: 4,834,367

[45] Date of Patent: May 30, 1989

[54] SUPINATOR/PRONATOR EXERCISE MACHINE

[75] Inventors: Alan Salyer, Ypsilanti; James M. Gittleson, Ann Arbor, both of Mich.

[73] Assignee: The Coach and Company Incorporated, Ypsilanti, Mich.

[21] Appl. No.: 207,734

[22] Filed: Jun. 16, 1988

[51] Int. Cl.[4] ..... A63B 21/00

[52] U.S. Cl. ..... 272/143; 272/117

[58] Field of Search ..... 272/67, 117, 118, 123, 272/134, 136, 142, 143

[56] References Cited

U.S. PATENT DOCUMENTS

| | | | |
|---|---|---|---|
| 4,373,717 | 2/1983 | Lambert, Jr. | 272/67 |
| 4,456,245 | 6/1984 | Baldwin | 272/118 |
| 4,511,137 | 4/1985 | Jones | 272/118 |
| 4,515,363 | 5/1985 | Schleffendorf | 272/118 |
| 4,621,807 | 11/1986 | Stramer | 272/117 |
| 4,629,184 | 12/1986 | Selkee | 272/143 X |
| 4,643,420 | 2/1987 | Riley et al | 272/136 X |
| 4,709,920 | 12/1987 | Schnell | 272/117 |
| 4,743,018 | 5/1988 | Eckler | 272/143 X |
| 4,763,897 | 8/1988 | Yakata | 272/118 |

FOREIGN PATENT DOCUMENTS

| | | | |
|---|---|---|---|
| 7609655 | 3/1978 | Netherlands | 272/117 |

*Primary Examiner*—Richard J. Apley
*Assistant Examiner*—Robert W. Bahr

[57] ABSTRACT

An exercise machine for performing supination and pronation exercises comprises a framework, a weight stack carriage that is supported on said frame work for vertical motion, and an input mechanism that is operably coupled by a cable and a system of sheaves on the framework to the weight stack carriage. The input mechanism comprises a horizontal shaft that has operating handles at opposite ends for rotating the shaft. A bi-cam is disposed on the shaft, and one end of the cable is tethered to a high point of the bi-cam. The bi-cam has respective cam profiles in its respective halves; one profile interacts with the cable when the shaft is rotated in one sense from a starting position, and the other profile interacts with the cable when the shaft is rotated in the opposite sense from the starting position. The cams have decreasing profiles so that the torque load imposed on the user progressively decreases as the shaft is rotated from the starting point, thereby enabling the machine to closely match the user's strength profile for performing supinations and pronations.

17 Claims, 2 Drawing Sheets

SUPINATOR/PRONATOR EXERCISE MACHINE

BACKGROUND AND SUMMARY OF THE INVENTION

This invention relates generally to exercise machines in which a user operates a weight stack by means of a cable that is trained by means of a system of sheaves to an input mechanism via which the user imparts motion to the weight stack.

Principles of the present invention are embodied in an exercise machine for performing supination and pronation exercises. These exercises are for strengthening principally the forearm and biceps and comprise a twisting motion that takes place generally about the elbow. Supination comprises a clockwise twisting of the right forearm, typically from a palm down position to a palm up position, and a counterclockwise twisting of the left forearm, also from palm down to palm up. Pronation involves counterclockwise twisting of the right forearm and clockwise twisting of the left forearm, both from a palm up position to a palm down position. The typical person can execute approximately 180° of supination and approximately 165° of pronation.

The present invention comprises a new and unique machine organization for enabling the user to perform both supination and pronation exercises of both arms. Moreover, the machine of the present invention is conveniently adjustable to accommodate different users. Since the machine involves the user operating a weight stack via a cable, the weight against which the user exercises can be conveniently controlled by adding or subtracting weights to and from the stack.

Although the illustrated machine is for the particular exercise purposes of supination and pronation, the machine contains generic principles that can be embodied in other types of exercise machines. This is because the machine comprises what is referred to as "bi-cam". The bi-cam is a rotary cam having two 180° segments. One of these segments is interactive with the cable during supination exercises. The other segment is interactive with the cable during pronations exercises.

The illustrated embodiment of the machine contemplates the user exercising only one arm at a time. The bi-cam, in combination with the weight stack, serves to adapt the resistance encountered during supination and pronation reasonably closely to the user's physiological ability, i.e. his or her strength curve. During an initial portion of both a supination and a pronation, the user can exert a greater torque than toward the conclusion of the exercise. The bi-cam takes this into account by automatically adapting the amount of cable that is displaced for a given amount of rotation of the bi-cam. In other words during an initial portion of both a supination and pronation, the cable is displaced a greater amount than it is toward the conclusion of the supination or pronation. Hence, even though the weight stack remains constant during an exercise, the effective torque which it imposes on the user is made variable in accordance with the general physiological capabilities of a person being able to exert a greater torque at the beginning of a supination or pronation than toward the conclusion of a supination or pronation.

The generic aspect of using the bi-cam to correlate the effective loading imposed on a user by a constant weight stack is applicable to other similar types of machines even though these other types of machines are not necessarily for performing just supination and pronation exercises.

Although the bi-cam comprises two 180° segments that correlate generally with the 180° of twisting that can be imparted during supination and pronation exercises, it is possible to adapt the bi-cam to other types of exercises which physiologically may not involve 180° motion in opposite directions. By configuring the input mechanism between the user and the bi-cam in any of various ways, different ratios may be evolved for adapting the bi-cam to a particular exercise. For example, a gear mechanism which sets an appropriate gear ratio between the user input and the bi-cam is one way in which adaptation can be made.

The foregoing features, advantages, and benefits of the invention, along with the additional ones, will be seen in the ensuing description and claims which should be considered in conjunction with the accompanying drawings. The drawings disclose a preferred embodiment of the invention in accordance with the best mode contemplated at the present time in carrying out the invention which happens to be in a supinator/pronator exercise machine.

DESCRIPTION OF THE PREFERRED EMBODIMENT

Figure 1:
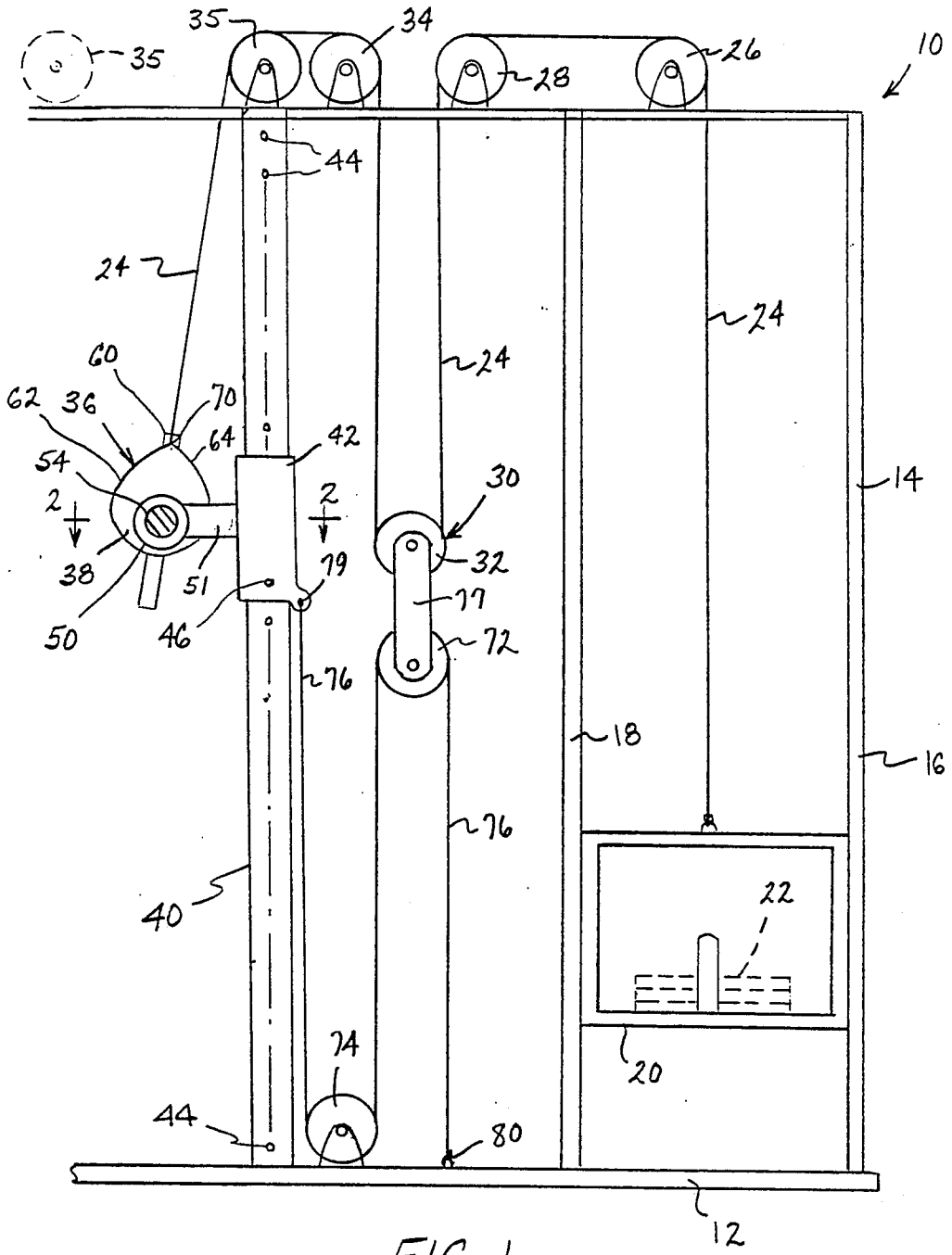
FIG. 1 is a front elevational view of a supinator/-pronator exercise machine embodying principles of the invention, certain portions of the machine being omitted in FIG. 1 for purposes of clarity in illustration.
Figure 2:
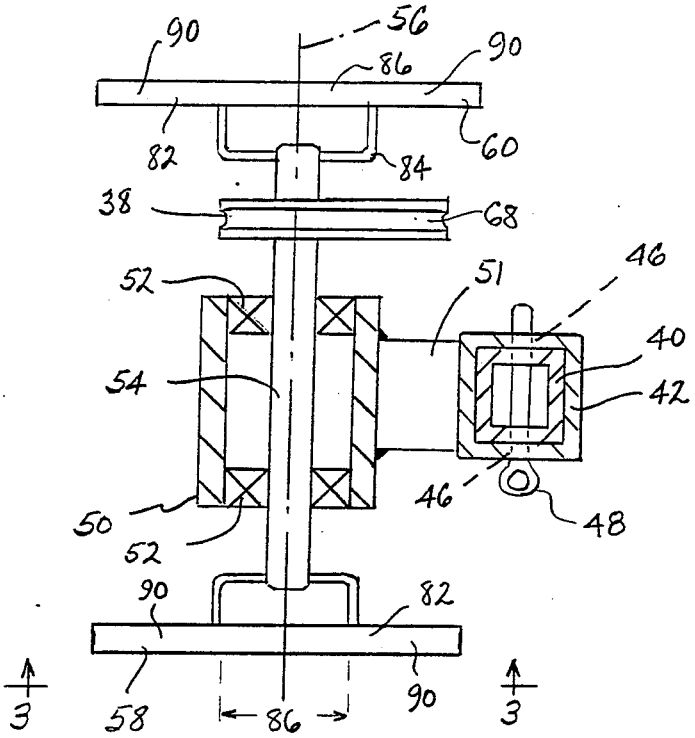
FIG. 2 is an enlarged horizontal cross sectional view taken generally in the direction of arrows 2—2 in FIG. 1 illustrating further detail including parts that are omitted from FIG. 1, but with the operating mechanism in a different operative position from that represented by FIG. 1.
Figure 3:
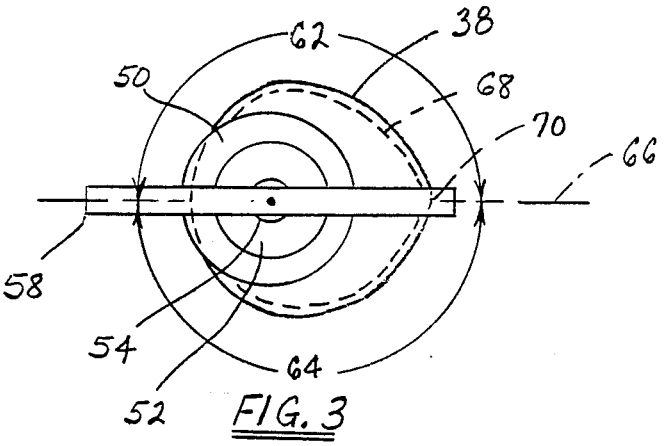
FIG. 3 is a view looking in the direction of arrows 3—3 in FIG. 1.

FIGS. 1, 2 and 3 taken together disclose a presently preferred embodiment of the exercise machine of this invention. Machine 10 comprises a horizontal base 12 on which an upright framework 14 is supported. Framework 14 includes a pair of vertical guides 16, 18 for guiding a weight stack carriage 20 for vertical motion. Weights 22 are added to or subtracted from carriage 20 in conventional manner to set a desired weight for the weight stack carriage.

A cable 24 is used to operate a weight stack carriage 20. One end of cable 24 is tethered centrally to the top of carriage 20. The cable extends vertically to train 90° around a sheave 26 that is suitably mounted on framework 14. Sheave 26 provides for a 90° transition of cable 24 so that from sheave 26 the cable extends horizontally to a second sheave 28 that is also mounted on framework 14 in suitable fashion. The sheave 28 is spaced horizontally from sheave 26 and the two sheave axes are parallel. Sheave 28 serves to train cable 24 from its horizontal transition between sheave 26 and sheave 28 to a vertically downward transition.

This vertically downward transition of cable 24 leads to an automatic slack take-up mechanism 30 whose purpose will be more apparent from the ensuing description. The cable trains 180° around an idler sheave 32 of mechanism 30, and from sheave 32 the cable extends back upwardly to a sheave 34 that is fixedly mounted on framework 14 in a suitable manner in horizontal alignment with sheaves 26, 28 and with its axis parallel to the axis of sheaves 26 and 28. Sheave 34 trains cable 24 for a 90° transition so that the cable extends from sheave 34 horizontally to a sheave 35. This latter sheave is adjustably positionable horizontally on framework 14, and both sheaves 34, 35 have their axes parallel to the other sheaves' axes. In the position of adjustment that is depicted by solid lines in FIG. 1, sheave 35 trains cable 24 for a transition that is slightly less than 90° so that the cable passes from sheave 35 at an angle that is slightly inclined from vertical. The cable terminates at an operating mechanism, 36 generally, which includes a bi-cam 38. Specifically the cable attaches to bi-cam 38.

Framework 14 includes a vertical post 40 on which operating mechanism 36 is mounted. The nature of the mounting however is such that the position of mechanism 36 can be set to any of a number of possible vertical positions of adjustment along the length of post 40. FIG. 1 shows mechanism 36 disposed just slightly above the mid-point of post 40. Post 40 has a tubular transverse shape that is rectangular or square.

Mechanism 36 comprises a tubular slide 42 whose transverse cross section is configured for a close sliding fit on post 40. The slide 42 constitutes a carriage via which mechanism 36 can be slid vertically along tube 40 to any of the available positions of adjustment. Each position of adjustment is defined by aligned holes 44 that pass through opposite walls of post 40. Carriage 42 has aligned holes 46 that register with each pair of holes 44 at each of the adjustment positions. The carriage is secured in an adjustment position by passing a removable pin 48 through the aligned holes 46, 44.

Attached to the exterior of slide 42 is a circular cylindrical tube 50. Attachment of tube 50 to slide 42 can be by any conventional means such as a welded bracket 51. Tube 50 contains a pair of bearing assemblies 52 which serve to coaxially journal a shaft 54 for rotation about the shaft's axis 56. The tube 50 and shaft 54 are arranged so that their co-axis is horizontal and parallel to the axis of the aforementioned sheaves.

Attached to opposite ends of shaft 54 are identical operating handles 58 and 60 respectively. Handle 58 is the near handle as viewed in FIG. 1 and handle 60 the far handle, although handle 58 is omitted from FIG. 1 for providing a certain degree of clarity to that figure. The two handles 58 and 60 are mounted to shaft 54 in exactly the same relative angular orientation; in other words, both handles occupy essentially a common plane.

Bi-cam 38 is disposed on shaft 54 between tube 50 and handle 60. Bi-cam 38 is a disk-like member that has a profile that is best seen in FIG. 3. The profile comprises two 180° segments 62, 64 respectively which by which way of example are mirror images of each other. In other words the bi-cam is symmetrical about an imaginary bisecting plane 66 which passes through axis 56. By way of further example, the developed profile of each bi-cam segment is linear, meaning that the radius decreases linearly along the angular extent of the profile. Bi-cam 38 further comprises a peripheral groove 68 following the profile as seen in FIG. 3.

The end of cable 24 that attaches to bi-cam 38 preferably attaches at the base of groove 68 at the highest point on the profile of the bi-cam. As can be seen in FIG. 3, this point is designated by the reference numeral 70. Any suitable means of attachment will do; for example a radial hole can be provided at the bottom of groove 68 for a predetermined depth. A larger hole extending from the side of the disk can intercept this radial hole. The cable can be passed through the two holes and a suitable stopper or plug attached to the cable so that the cable cannot be pulled back out through the holes.

Mechanism 30 further comprises in addition to sheave 32, sheaves 72, 74 and a cable 76 that is trained around these latter two sheaves. Sheave 74 is mounted on base 12 with its axis parallel to all other sheave axes. Sheave 72 mounts on one end of a bracket assembly 77 on whose opposite end sheave 32 mounts. The axis of sheave 72 is parallel to all the other sheave axes. One end of cable 76 is tethered to slide 42 as indicated by the reference numeral 79. From this point of tethering the cable extends vertically downwardly to loop 180° around sheave 74. From sheave 74 the cable extends upwardly to loop 180° around sheave 72. From sheave 72 the cable extends vertically downwardly to be tethered to base 12 at the point of tethering 80. The manner of which mechanism 30 functions to take up slack in cable 24 can be explained as follows.

Let it be assumed that carriage 20 is fixed at any given vertical position along guides 16 and 18. Unpinning of carriage 42 from post 40 enables the carriage and mechanism 36 to be slid upwardly or downwardly along post 40. If the carriage is slid upwardly, it will exert a pulling force on cable 76 that will result in sheave 72 being pulled down downwardly. Since sheave 72 is affixed to sheave 32 by the bracket structure 76, sheave 32 will be pulled downwardly the same amount as sheave 72. The extent to which cable 76 is pulled upwardly at its point of tethering to slide 42 will substantially equal the amount by which the point of attachment of cable 24 to bi-cam 38 moves upwardly. Since this amount of upward movement of the bi-cam will tend to create a slack in cable 24, that slack is automatically taken up by the downward displacement of sheave assembly 32 so that mechanism 30 thereby operates as an automatic slack take-up mechanism during adjustment of the position of the mechanism 38 vertically along post 40. Downward displacement of slide 42 on post 40 will result in upward displacement of sheave 32, a motion that is transmitted to create a corresponding upward motion of sheave 72 so that regardless of whether slide 42 is moved up or down, slack is automatically taken out of cable 24.

In the illustrated embodiment of the invention the entire weight of carriage 20 is exerted on cable 24; in other words, the carriage is not capable of being lowered fully onto base 12 where the base could support the carriage weight. By this preloading of cable 24, bi-cam 38 is inherently biased to the position shown in FIG. 1. In other words, the pre-tension force in cable 24 will seek to circumferentially orient bi-cam 38 such that the segment of cable 24 that extends from sheave 35 to bi-cam 38 lies substantially on a radial to axis 56. While the exact manner of interaction of the bi-cam with the cable will become more apparent from the ensuing description, a sufficient amount of bi-cam rotation in the clockwise sense from the position shown in FIG. 1 will cause segment 62 of the bi-cam to interact with cable 24; sufficient counterclockwise rotation of the bi-cam in the counterclockwise sense from the position of FIG. 1 will cause segment 64 to come into interaction with cable 24.

For use in performing supination and pronation exercises, the two handles 58 and 60 are pre-positioned by a certain amount of rotation from the position illustrated in FIG. 1 so as to be horizontal at the beginning of an exercise. This pre-positioning also horizontally positions plane 66 that bisects the bi-cam. FIGS. 2 and 3 depict the operating mechanism with handles 58, 60 and plane 66 horizontal.

Each handle comprises a gripping bar 82 that joins with shaft 54 by means of a generally U shaped bracket structure 84. Pronation and supination exercises are performed by grasping one of the bars 82 within the gripping region designated by the numeral 86. For example, supination is performed by gripping region 86 of the gripping bar 82 of handle 58 with the right hand palm down, and rotating the handle, the shaft and bi-cam in the clockwise sense as viewed in FIG. 1. Rotation in this clockwise sense will result in a pulling force being exerted on cable 24 that will elevate carriage 20. When the gripping bar is pre-positioned horizontally at the beginning of the exercise, the cable will not be at or close to tangency with the bi-cam at the beginning of segment 62. Since the initial pre-positioning will cause an elevation of the weight stack carriage, each gripping bar is provided with extensions 90 that are outboard to each side of the central gripping region 86 for the purpose of aiding the pre-positioning by using both arms.

As clockwise rotation is continued from the pre-position point, the cable will begin to wrap onto the bi-cam, specifically beginning to wrap into the bi-cam segment 62. Since a supination involves approximately 180° of rotation of the forearm, handle 58, and hence bi-cam 38, will have been rotated approximately 180° from the pre-position point by the conclusion of one supination.

Because of the profile of the bi-cam, the increased wrapping of the cable around the bi-cam will be at a progressively decreasing radius. Hence, although the amount of force in the cable is fixed due to the weight imposed by carriage 20, the rate at which cable is taken up by the bi-cam will not be constant throughout the supination exercise.

The amount of torque exerted will be fairly constant until the cable begins to wrap around the bi-cam; thereafter the amount of torque that must be exerted to continue elevating the weight stack, will begin to progressively decrease because the cable is being taken up at a decreasing radius of the bi-cam. Stated another way, a given amount of angular rotation will result in a progressively decreasing amount of cable take-up the farther the bi-cam has been rotated. This characteristic matches fairly well the physiological capability of the arm when performing a supination exercise because at the beginning of the exercise the user is capable of exerting maximum torque while the amount of torque which the user can exert begins to progressively diminish from this maximum the further the user goes into the exercise. The negative of the exercise occurs when the handle is allowed to rotate in the opposite sense in which case the user acts a resistance to control the dropping of the weight stack.

Pronation exercise of the right forearm is also performed using handle 58. In this case however, sheave 35 is first re-positioned on framework 14 to the left from the position of FIG. 1 (the re-positioning being shown in phantom) so that after handle 58 has been pre-positioned for the beginning of a pronation by counterclockwise rotation, point 70 is at 9 O'clock as viewed in the direction of FIG. 1, and the segment of cable that extends downwardly from sheave 35 is vertical and essentially tangent to the bi-cam at the beginning of segment 64. With the machine in such an orientation, the user, grasping the handgrip 86 of handle 58 with his right hand palm up, rotates the handle, and hence the bi-cam, in the counterclockwise sense causing a pulling force to be exerted on cable 24. Substantially constant torque will be exerted by the weight until the cable begins to wrap into the groove around segment 64 of the bi-cam. Since the profile of the bi-cam is of a progressively decreasing radius as the rotation continues, a given amount of angular rotation will result in a decreasing amount of take-up of the cable the farther the rotation progresses. The torque that is imposed by the weight stack is correspondingly reduced is a manner fairly well matching the physiological characteristic of the arm. The negative of the exercise is performed by allowing clockwise rotation in which case the dropping of the weight is controlled via the handle.

By providing handle 60 on the opposite side of shaft 54 from handle 58 the machine enables the user to perform both supination and pronation exercises for both arms. Handle 60 is used to perform supination and pronation exercises for the left arm. When performing the left arm exercises, it is to be understood that the user repositions himself or herself to the opposite side of the machine. Supination of the left arm produces exactly the same machine motion as supination of the right arm. Similarly, pronation of the left arm produces the same machine motion as pronation of the right arm.

One of the advantages of the invention is that supination and pronation exercises for both arms are embodied in a single machine which is convenient to adjust for the needs of the individual user. All the user need do is set the desired vertical position for slide 42 on bar 40 and set the desired weights 22 in carriage 20. The user can perform supination and pronation exercises of one arm by standing at one side of the machine. Supination and pronation exercises of the other arm are performed by the user repositioning himself, or herself, to the other side and using the other handle. The extensions 90 are also useful at such times as the user may wish to use his, or her, free arm in aiding the arm that is being exercised, such as when the arm being exercised begins to become fatigued.

As mentioned earlier, the invention possesses generic principles involving the relationship of the bi-cam to the particular exercise and therefore these generic principles may be embodied in other types of weight machines other than the specific supinator/pronator machine that has been illustrated.

Different characteristics for different exercises can be created by the particular profile of the bi-cam. The two halves of the bi-cam can be mirror images as described above, or each can be unique unto itself. The profile can be linear (i.e. falling off at a constant rate), or it can be non-linear. In some implimentations of the invention, an adjustable sheave, such as the sheave 35, may not be required.

While the exercise machine may be used for recreational type exercise, it also has important use for physical therapy type rehabilitative exercises, and for the latter type of use a mini-weight carriage may optionally be employed. "Tennis elbow" is one of the ailments that may benefit through use of the illustrated supinator/-pronator. Therefore while a preferred embodiment of the invention has been disclosed, it will be appreciated that principles are applicable to other embodiments.

What is claimed is:

1. A supinator/pronator exercise machine comprising a frame, a load supported on said frame, an input mechanism that is operably coupled by a cable and a system of sheaves for enabling the user to perform supination and pronation exercises against said load, said input mechanism comprising an operating handle and means for supporting said operating handle on said framework for rotation about an axis and a rotary bi-cam that is rotated by rotation of said handle, means tethering the cable to a particular location on the periphery of said bi-cam, said bi-cam comprising respective cam profiles in respective halves of the bi-cam, one of said profiles being interactive with said cable when the handle is rotated in one sense to perform one of said supination and pronation exercises and the other profile being interactive with the cable when the handle is rotated in the opposite sense to perform the other of said supination and pronation exercises.

2. A supinator/pronator exercise machine as set forth in claim 1 in which said input mechanism is supported on a post for selective positioning therealong and including an automatic slack take-up mechanism acting on said cable and responsive to the positioning of said input mechanism along said post for automatically taking slack out of said cable as said input mechanism is positioned along said post.

3. A supinator/pronator exercise machine as set forth in claim 1 in which said means for supporting said handle for rotation about an axis comprises a shaft that is journaled for rotation about said axis and said bi-cam is affixed to said shaft so as to be co-axial with said handle.

4. A supinator/pronator exercise machine as set forth in claim 3 in which said handle is disposed at one end of said shaft and including a second handle disposed at the other end of said shaft, said bi-cam being disposed between said handles.

5. A supinator/pronator exercise machine as set forth in claim 4 in which an imaginary plane that passes through said axis bisects said bi-cam into its respective halves and said handles are arranged to lie in said imaginary plane.

6. A supinator/pronator exercise machine as set forth in claim 5 in which said handles comprise a central gripping region of a length for grasping by a person's hand and include extensions on opposite sides of said gripping region for grasping by the other hand.

7. A supinator/pronator exercise machine as set forth in claim 6 in which each handle is attached to said shaft by a corresponding U shaped bracket that attaches to the corresponding handle at locations bounding said central gripping region, said extensions being outboard of the locations of the brackets' attachments to said handles.

8. A supinator/pronator exercise machine as set forth in claim 1 in which said means for supporting said handle for rotation about an axis comprises a shaft that is journaled for rotation about said axis and including a second handle disposed at the other end of said shaft.

9. A supinator/pronator exercise machine as set forth in claim 8 in which an imaginary plane passes through said axis and said handles are arranged to lie in said imaginary plane.

10. A supinator/pronator exercise machine as set forth in claim 9 in which said handles comprise a central gripping region of a length for grasping by a person's hand and include extensions on opposite sides of said gripping region for grasping by the other hand.

11. A supinator/pronator exercise machine as set forth in claim 10 in which each handle is attached to said shaft by a corresponding U shaped bracket that attaches to the corresponding handle at locations bounding said central gripping region, said extensions being outboard of the locations of the brackets' attachments to said handles.

12. A supinator/pronator exercise machine as set forth in claim 1 in which said cable is tethered to a high point of the bi-cam which lies between said respective cam profiles, said respective cam profiles having progressively decreasing radii along the angular directions extending away from said high point.

13. A supinator/pronator exercise machine as set forth in claim 12 in which said load comprises a weight stack and said cable is pre-loaded by said weight stack so that said cable is under tension, such pre-loading tension serving to bias the bi-cam to a particular circumferential orientation such that at its point of tethering to the bi-cam, said cable lies on a radial to the bi-cam.

14. An exercise machine comprising a frame, a load supported on said frame, an input mechanism that is operably coupled by a cable and a system of sheaves for enabling the user to perform exercises in opposite senses against said load, said input mechanism comprising an operating handle and means for supporting said operating handle on said framework for rotation about an axis and a rotary bi-cam that is rotated by rotation of said handle, means tethering the cable to a particular location on the periphery of said bi-cam, said bi-cam comprising respective cam profiles in respective halves of the bi-cam, one of said profiles being interactive with said cable when the handle is rotated in one sense to perform one exercise and the other profile being interactive with the cable when the handle is rotated in the opposite sense to perform the other exercise, said bi-cam having its profiles arranged to match the user's strength profiles for the operation of said handle in opposite senses.

15. An exercise machine as set forth in claim 14 in which said means for supporting said handle for rotation about an axis comprises a shaft that is journaled for rotation about said axis and said bi-cam is affixed to said shaft so as to be co-axial with said handle.

16. An exercise machine as set forth in claim 15 in which said handle is disposed at one end of said shaft and including a second handle disposed at the other end of said shaft, said bi-cam being disposed between said handles.

17. An exercise machine as set forth in claim 16 in which an imaginary plane that passes through said axis bisects said bi-cam into its respective halves and said handles are arranged to lie in said imaginary plane.

* * * * *